US005117608A

United States Patent [19]

Nease et al.

[11] Patent Number: 5,117,608

[45] Date of Patent: Jun. 2, 1992

[54] POUCH PROFILE DETECTOR

[75] Inventors: Mark R. Nease, Lakeside Park; Robert M. Kalany, Florence; Michael E. Myers, Bellevue, all of Ky.

[73] Assignee: R. A. Jones & Co. Inc., Covington, Ky.

[21] Appl. No.: 682,933

[22] Filed: Apr. 10, 1991

[51] Int. Cl.[5] ..... B65B 41/18; B65B 43/36

[52] U.S. Cl. ..... 53/51; 53/385.1; 83/176; 83/270

[58] Field of Search ..... 53/51, 64, 562, 570, 53/385.1, 386.1, 389.3, 76, 479; 83/169, 176, 270, 272

[56] References Cited

U.S. PATENT DOCUMENTS

| | | | |
|---|---|---|---|
| 3,449,887 | 6/1969 | Abramson | 53/76 |
| 3,700,388 | 10/1972 | Johnson et al. | 53/562 |
| 3,762,617 | 10/1973 | Matthis | 53/51 X |
| 3,886,713 | 6/1975 | Mitchell et al. | 53/479 X |
| 4,082,596 | 4/1978 | Vanderpool | 53/76 X |
| 4,201,031 | 5/1980 | Wiles | 53/562 X |
| 4,680,205 | 7/1987 | Lerner et al. | 53/51 X |
| 4,783,950 | 11/1988 | Santagati | 53/76 X |
| 4,956,964 | 9/1990 | Jones et al. | 53/570 |

*Primary Examiner*—Horace M. Culver
*Attorney, Agent, or Firm*—Wood, Herron & Evans

[57] ABSTRACT

A web of pouches is fed past a detector. Inflating mechanism inflates individual pouches to create individual profiles. The detector responds to the appearance of a preselected distance between the surface of the pouch and the detector as each pouch passes the detector.

5 Claims, 4 Drawing Sheets

POUCH PROFILE DETECTOR

BACKGROUND OF THE INVENTION

This invention relates to an adjustable pouch form, fill, seal machine wherein a web is formed into a continuous series of pouches separated by transverse seals. More particularly, the invention relates to apparatus for locating the position of each seal on the web and employing that information to cut the web on the center of each seal to form individual pouches.

The apparatus of the present invention is an improvement in the apparatus of U. S. Pat. No. 4,956,964 whose disclosure is incorporated herein by reference.

In the apparatus described in the '964 patent, a web of heat-sealable film or a laminate containing a ply of heat-sealable film is longitudinally folded upon itself and thereafter transversely heat-sealed to form individual pouches interconnected at their seals. The web may have no printing or may have random printing without registration marks. Where a web has registration marks through which it is possible to locate the seals so that a cutting knife can cut on the center of the seals, it is easy enough to use an electric eye to locate the registration mark and effect cutting using the information obtained by the electric eye.

The '964 patent addresses the problem of locating the seal where there are no registration marks present. The patent discloses apparatus that includes a walking star, that is, a rotary element having uniformly spaced arms that project into individual pouches as the pouches pass the walking star. The walking star is rotated by the engagement of the edge of each arm by the seal that defines the pouch. Thus, the annular position of the walking star is directly related to the longitudinal position of the seal on the web. An encoding system transmits the information concerning the annular position of the walking star to a computer which in turn operates the cutting apparatus.

A problem has arisen that in some circumstances the walking star becomes disengaged from the pouches causing a loss of registration. The operator might have to stop the machine to tuck the arms of the star back into the pouches.

BRIEF SUMMARY OF THE INVENTION

The objective of the present invention has been to provide a more reliable apparatus for detecting the position of the transverse seals on a web of unprinted or randomly printed pouches so that cutting can be performed at the center of the seals.

This objective of the present invention is attained by inflating the pouches uniformly so that they present a readable profile. An electric eye or other comparable detecting apparatus is provided to scan the pouch profiles as the web moves past the detector and to detect a preselected point on each pouch. That preselected point could be the seal, or it could be a point on the surface of the pouch. It acts as a registration mark. As each identical point passes the detector, the information is transmitted to a computer that controls the mechanism that feeds the pouches to the cutoff knife, to cause the cutoff knife to cut on the center of the seal.

BRIEF DESCRIPTION OF THE DRAWINGS

The objectives and features of the invention will become more readily apparent from the following detailed description taken in conjunction with the accompanying drawings in which:

Referring to FIG. 1, there is shown apparatus 10 for forming a series of pouches 11 forming a web 12 of heat-sealable film or a laminate containing heat-sealable film. A registration and cutoff mechanism 15 is immediately downstream from the pouch forming apparatus. Individual pouches 16 received from the cutoff mechanism are transported on a chain conveyor 17 through a filler 18. After being filled, the upper edges of the pouches are heat-sealed by passing through a sealer 19.

Figure 1:
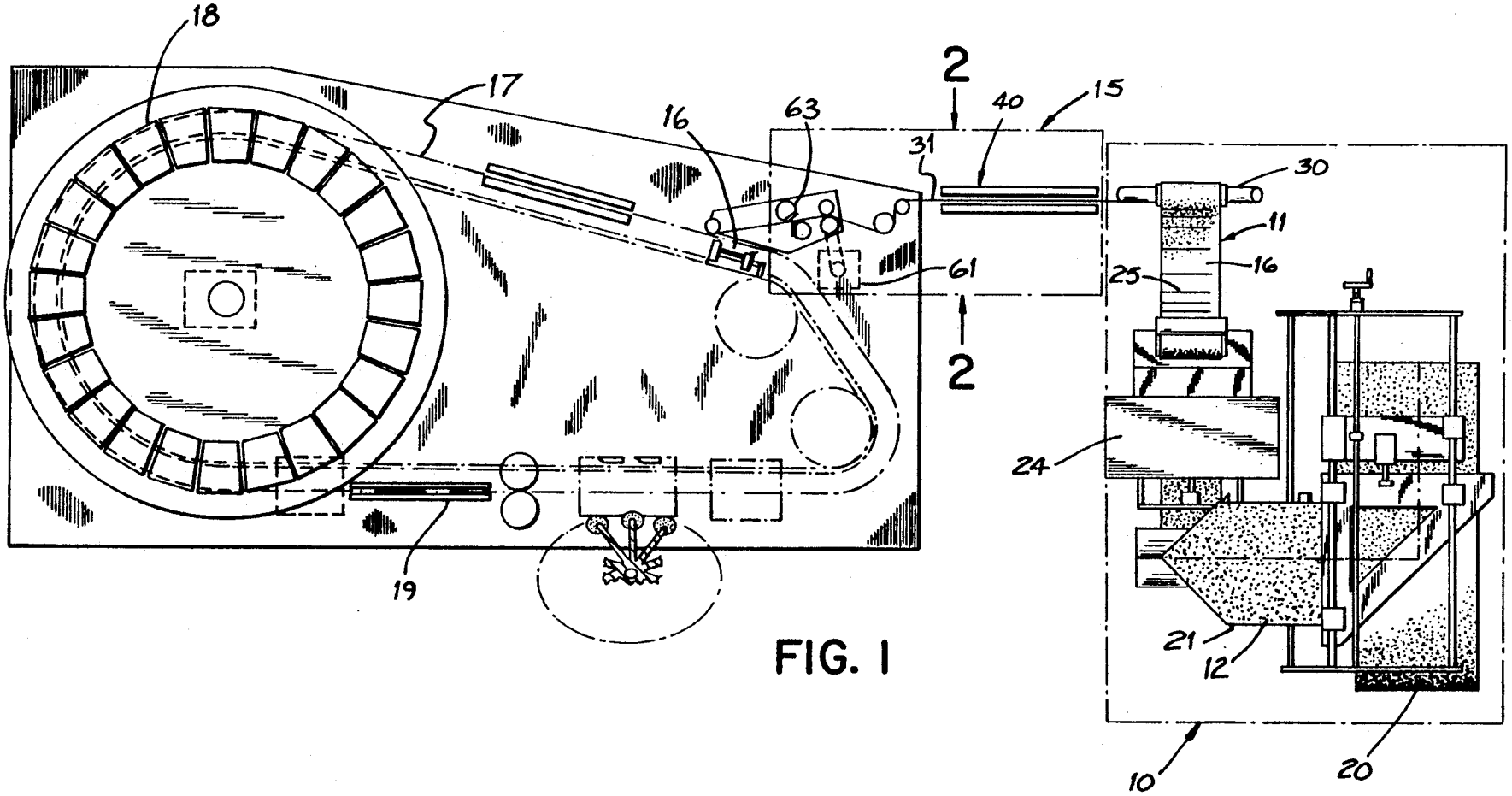
FIG. 1 is a diagrammatic plan view of the pouch form, fill, seal machine with which the present invention is used.
Figure 2:
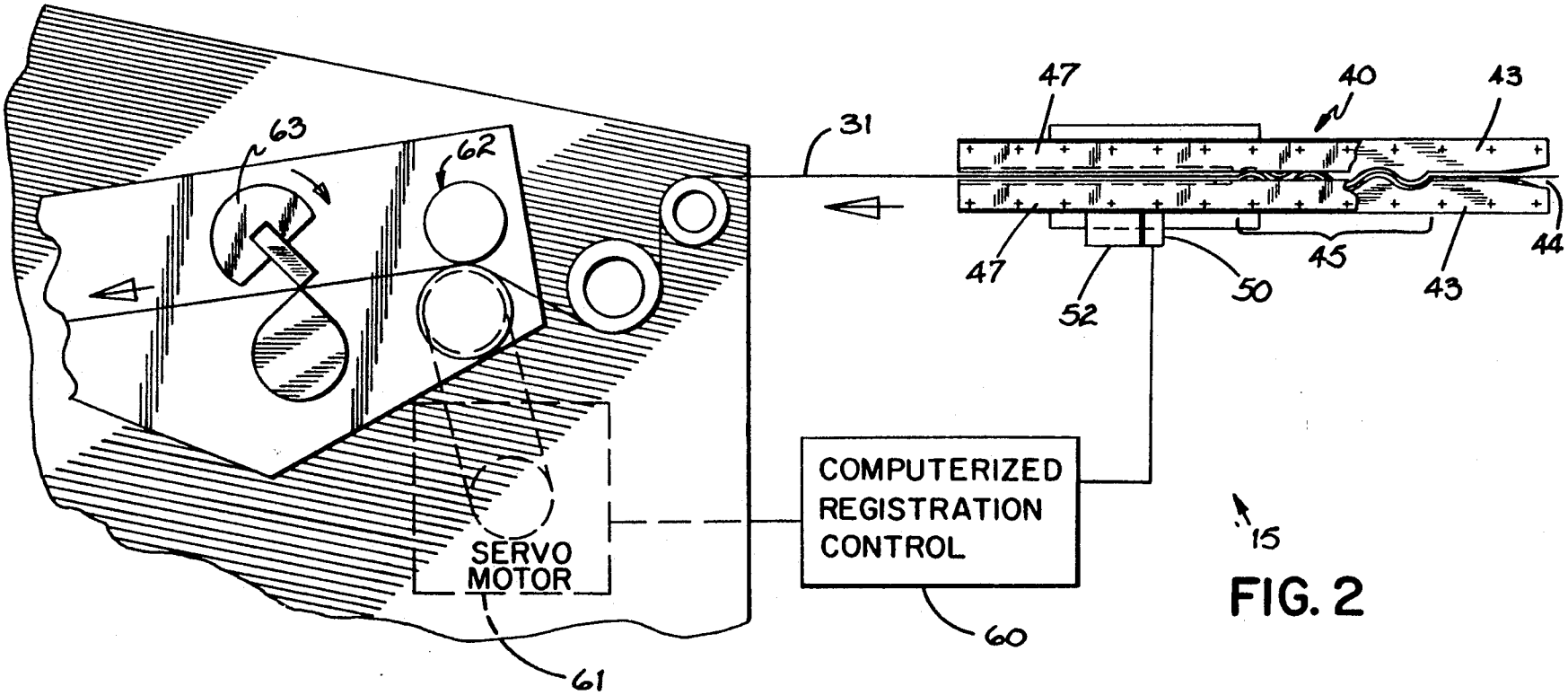
FIG. 2 is an enlarged diagrammatic plan view of the detector and cutoff apparatus defined in the outlined area 2—2 of FIG. 1.

In somewhat more detail, the supply roll 20 of film 12 is fed over a plow 21 that folds the film longitudinally upon itself. A transverse sealing station 24 forms transverse seal 25 to define the individual pouches 16 connected together along their seals. The web is fed over a turning bar 30 to vertically orient the web as at 31. There, the web of interconnected pouches, open at the top edge, passes through the detector apparatus of the present invention and the cutoff mechanism to form the separated pouches, all as shown in FIGS. 2 and 3.

Figure 3B:
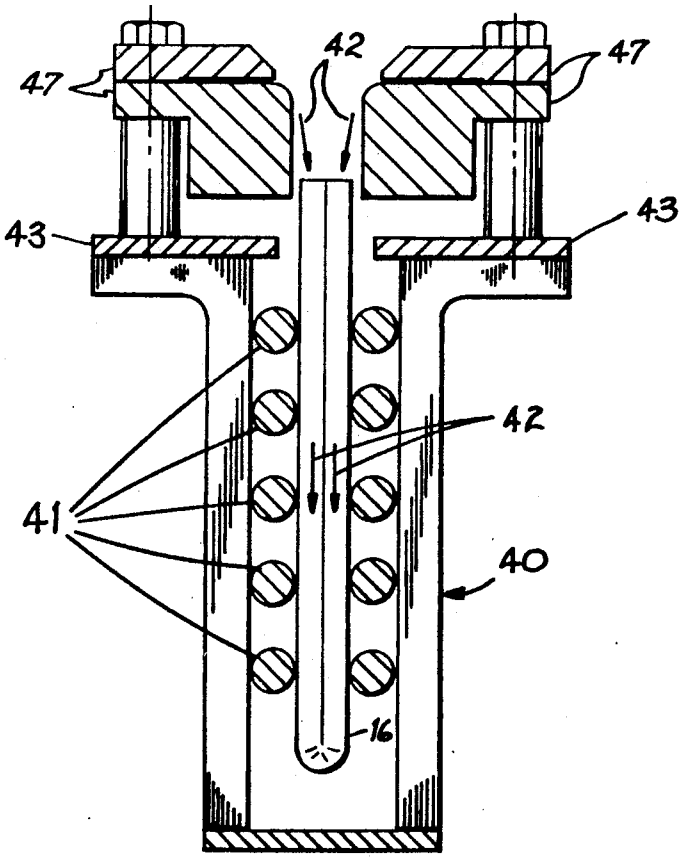
FIG. 3*b* is a cross-sectional view taken on line 3*b*–3*b* of FIG. 3.
Figure 3A:
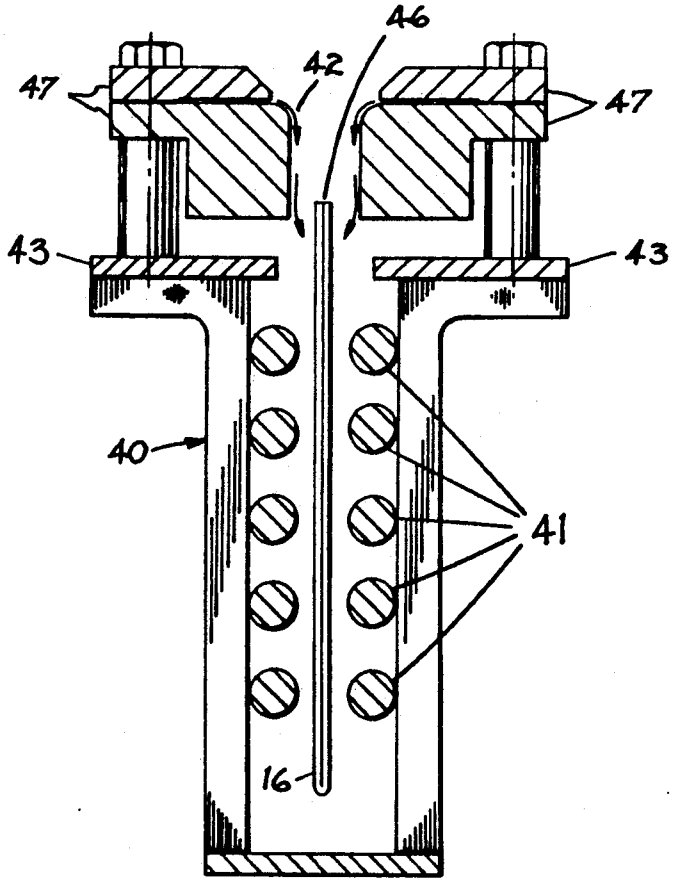
FIG. 3*a* is a cross-sectional view taken on line 3*a*–3*a* of FIG. 3.
Figure 3:
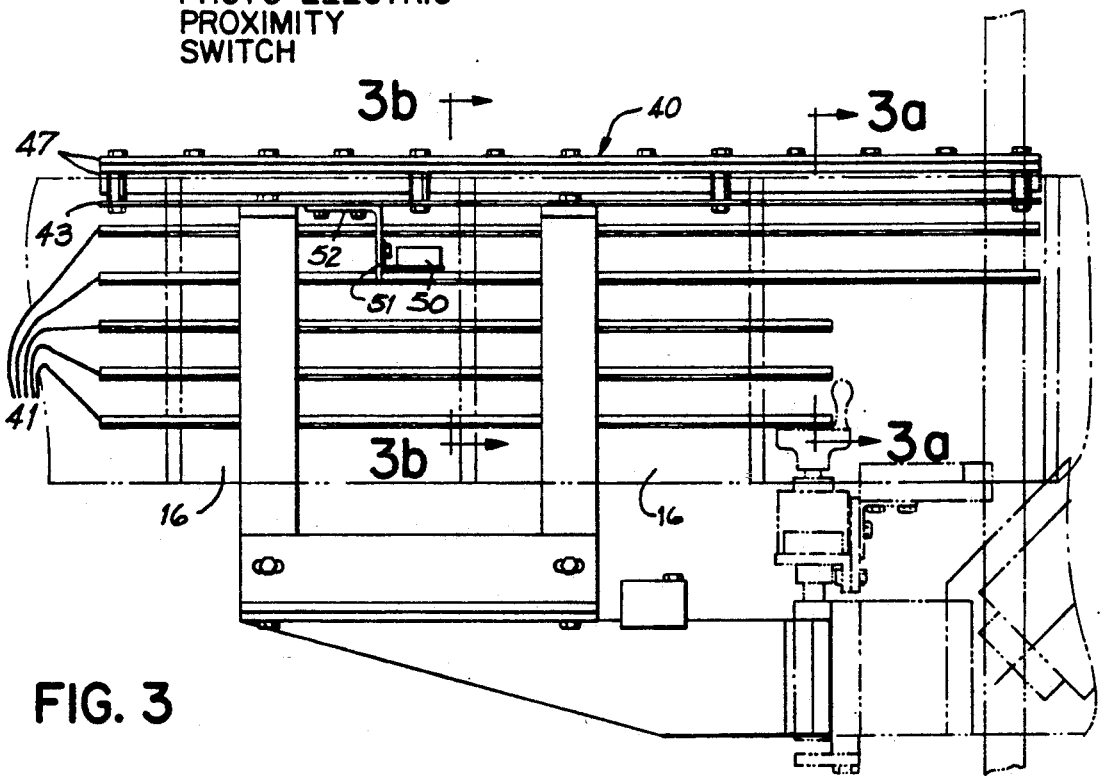
FIG. 3 is a side elevational view of the detection apparatus.

Referring to FIGS. 2, 3, 3*a* and 3*b*, a pouch opening mechanism is shown at 40. Five vertically-spaced bars 41 on each side of the apparatus form a passage through which the web of interconnected pouches passes. The distance that the bars 41 are transversely spaced apart can be varied. A nominal distance is about ½ inch. Above the spacer bars 41 are a pair of serpentine gap-forming bars 43. Their transverse spacing may also be varied. The gap-forming bars 43 diverge as at 44 at the upstream end of the opening apparatus. The bars thereafter form a serpentine gap over a distance indicated by the bracket 45. Having the open end or mouth of each pouch pass through the serpentine gap causes the abutting surfaces of the film at the mouth of each pouch to spread apart ever so slightly. Bars 47 overlying the serpentine gap-forming bars 43 are connected to a constant source of air under pressure 42 As seen in FIGS. 3*a* and 3*b*, the bars direct the air 42 down along each side of the web. The upstream portion of the pouch, through the serpentine section 45, is opened by air 42 blowing down the outside walls of the pouch. It creates, through the Bernoulli effect, a condition of low pressure. The slight opening of each pouch caused by the serpentine gap, coupled with a positive pressure differential between the inside and outside of the pouches, causes each pouch to begin to pop open, as at 46. As soon as the mouth of each pouch begins to pop open, air from the bars 47 blows into the pouch and completes the opening process. The bars 41 limit the extent of opening as diagrammatically shown in FIGS. 4, 5 and 3*b*. A detector 50 is mounted on a bracket 51 which is in turn secured at 52 to a gap bar 43.

In a preferred form of the invention, the detector is a photoelectric proximity switch having an adjustable focal point. A light beam is directed onto a surface and is reflected back onto a photocell. If the surface is at the focal point, the device generates a signal. That signal is comparable to the detection of a registration point on a web.

Figure 4:
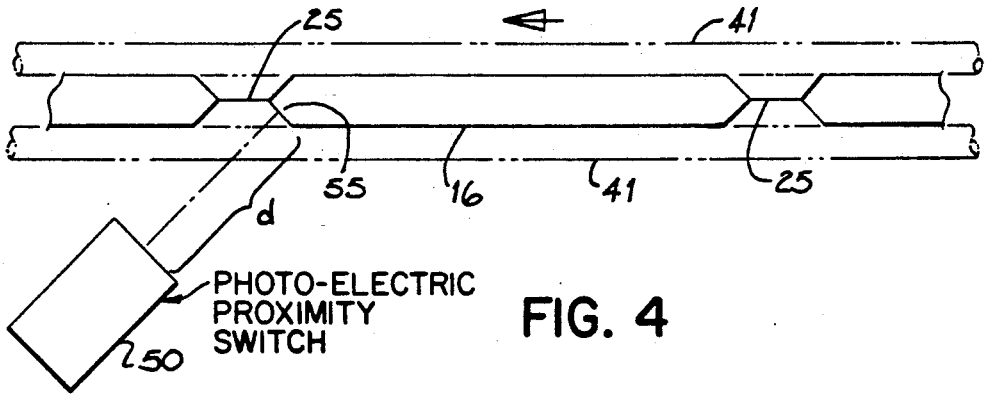
FIG. 4 is a diagrammatic illustration of the pouch and the profile detecting apparatus.
Figure 5:
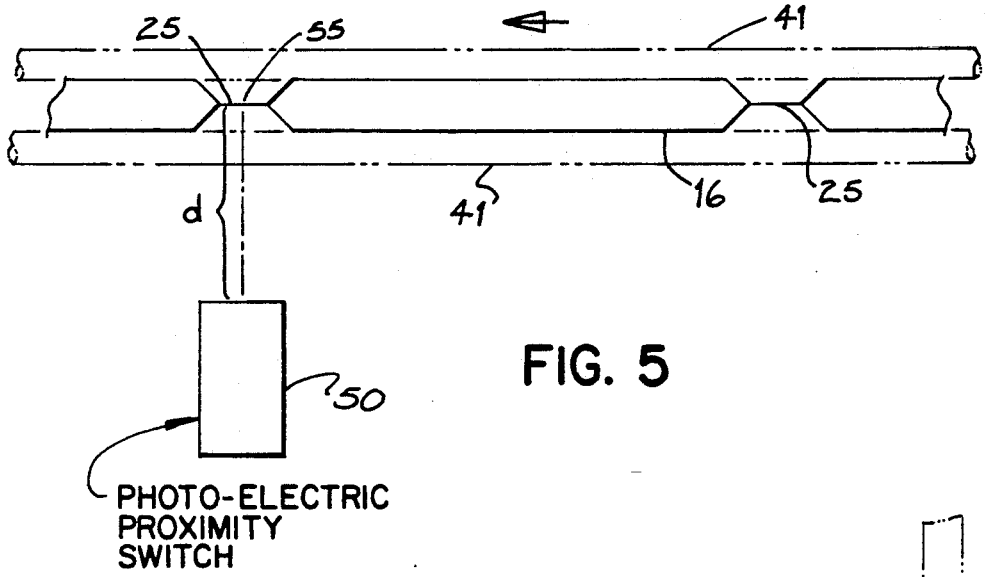
FIG. 5 is a diagrammatic view of an alternative embodiment.

As shown in FIGS. 4 and 5, the preselected distance corresponding to the focal point of the photoelectric proximity switch is indicated at 55. As the pouch is moving past the detector from right to left, the focal point, at a preselected distance d, causes the detector 50 to generate a signal when the point 55 is at the position shown. The detector 50 is connected through a computerized registration control 60 to a servomotor 61 which drives the feed rolls 62 feeding the web into a cutting knife 63. The speed of the servomotor 61 is either advanced or retarded depending upon the position of the focal point 55 with respect to the position of the cutting knife.

As shown in FIG. 5, the focal point might be on the seal itself so that as soon as the seal passes the beam from the detector, the registration control will be signalled to cause the proper feeding of the web into the cutting knife.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof:

We claim:

1. Apparatus for registering pouch seals on a web of pouches comprising:

means for forming a continuous, substantially two-dimensional web of vertically-oriented pouches having open upper ends, said pouches being delineated by spaced vertical seals, pneumatic means for opening said pouches to create a discernible profile, means for reading the profile of each pouch and seal, means for cutting said web on each said seal, and means for controlling said cutting means as determined by said profile reading means, thereby causing said web to be cut at approximately the center of each seal.

2. Apparatus as in claim 1 in which said reading means comprises photoelectric means for determining the time that the surface of the web is a preselected distance from said photoelectric means.

3. Apparatus as in claim 1 in which said reading means comprises a photoelectric proximity switch whose focal point is on the seal between pouches.

4. Apparatus as in claim 1 in which said reading means comprises a photoelectric proximity switch whose focal point is on a surface of each pouch that is at and to the direction of movement of the web of pouches.

5. Apparatus for detecting the position of each transverse seal on a web of interconnected, substantially two-dimensional pouches comprising:

means for inflating each pouch to create a discernible profile, means for confining the lateral extend of bulging of inflated pouches, and a detector sensitive to changes in the lateral profile of the pouches mounted on said confining means and directed at the side surfaces of said pouches, said detector generating a signal when a preselected distance of pouch surface to detector passes said detector.

* * * * *

UNITED STATES PATENT AND TRADEMARK OFFICE

CERTIFICATE OF CORRECTION

PATENT NO. : 5,117,608

DATED : June 2, 1992

INVENTOR(S) : Mark R. Nease et al.

It is certified that error appears in the above-identified patent and that said Letters Patent is hereby corrected as shown below:

In column 4, line 30, "lateral extend" should be --lateral extent--.

Signed and Sealed this

Twenty-eighth Day of June, 1994

*Attest:*

Bruce Lehman

BRUCE LEHMAN

*Attesting Officer*

*Commissioner of Patents and Trademarks*